US008122893B2

(12) United States Patent
Boldrini

(10) Patent No.: US 8,122,893 B2
(45) Date of Patent: Feb. 28, 2012

(54) MACHINE FOR MANUFACTURING POUCHES OF COHESIONLESS MATERIAL

(75) Inventor: Fulvio Boldrini, Ferrara (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 295 days.

(21) Appl. No.: 12/312,654

(22) PCT Filed: Nov. 19, 2007

(86) PCT No.: PCT/IB2007/003607

§ 371 (c)(1),
(2), (4) Date: May 20, 2009

(87) PCT Pub. No.: WO2008/062302

PCT Pub. Date: May 29, 2008

(65) Prior Publication Data

US 2010/0059069 A1 Mar. 11, 2010

(30) Foreign Application Priority Data

Nov. 22, 2006 (IT) ..... BO2006A0791

(51) Int. Cl.
*A24B 1/08* (2006.01)

(52) U.S. Cl. ..... 131/112; 53/180; 53/202; 131/283

(58) Field of Classification Search ..... None
See application file for complete search history.

(56) References Cited

U.S. PATENT DOCUMENTS

| | | | |
|---|---|---|---|
| 2,294,215 | A | 8/1942 | Sonneborn |
| 3,026,660 | A | 3/1962 | Luthi |
| 4,703,765 | A | 11/1987 | Paules |
| 5,694,741 | A | 12/1997 | Weder |

FOREIGN PATENT DOCUMENTS

| | | | |
|---|---|---|---|
| DE | 10 45 310 | B | 11/1958 |
| DE | 21 09 834 | A1 | 9/1972 |
| DE | 296 20 828 | U1 | 5/1997 |
| DE | 195 35 515 | A1 | 9/1997 |
| WO | WO 2005/113218 | A | 12/2005 |

*Primary Examiner* — Richard Crispino
*Assistant Examiner* — Phu Nguyen
(74) *Attorney, Agent, or Firm* — Timothy J. Klima; Shuttleworth & Ingersoll, PLC

(57) ABSTRACT

Pouches (2) of a smokeless tobacco product are manufactured on a machine comprising an intermittently rotatable dispensing disc (3) with peripheral cavities (4), a station (5) at which each cavity (4) is filled with a given quantity of tobacco equivalent to a single portion, a push rod mechanism (12) by which the portions of tobacco are ejected from each cavity (4) of the disc (3) at a transfer station (6), and a connecting duct (8) through which the portion of tobacco ejected by the push rod from each cavity passes directly to a wrapping station (7) where the pouches (2) are formed, filled with the tobacco product and sealed.

10 Claims, 3 Drawing Sheets

MACHINE FOR MANUFACTURING POUCHES OF COHESIONLESS MATERIAL

This application is the national phase of international application PCT/IB2007/003607 filed Nov. 19, 2007 which designated the U.S. and that international application was published under PCT Article 21(2) in English. This application claims priority to Italian Patent application number BO2006A000791, filed Nov. 22, 2006, which is incorporated by reference herein.

TECHNICAL FIELD

The present invention relates to a machine for manufacturing individual bags or sachets of cohesionless material, and in particular, pouches of nasal snuff, or of moist snuff (also known as snus) for oral use.

Reference is made explicitly to tobacco in the course of the following specification, albeit no limitation in scope is implied, as the cohesionless material might consist similarly, for example, in powdered pharmaceutical or confectionery products treated with moisturizing agents.

BACKGROUND ART

The prior art embraces machines of the type in question, which comprise a dispensing disc rotatable intermittently about a vertical axis and furnished with a ring of cavities, each containing a quantity or portion of tobacco that will correspond to the contents of a single pouch.

The portions are released into the single cavities at a filling station by a hopper containing a supply of powdered tobacco, en masse, treated with flavouring and moisturizing agents.

Downstream of the filling station, the machine comprises skimming means that serve to remove any excess tobacco from each of the cavities.

With the disc in rotation, the cavities are carried beyond the skimming means and toward a transfer station where the single portion of tobacco contained in each cavity is ejected.

Installed at this same station are pneumatic ejection means comprising a nozzle positioned above the dispensing disc. At each pause in the movement of the disc, a portion of tobacco is forced by the nozzle from the relative cavity into a duct, of which the mouth lies beneath the disc and in alignment with the nozzle, and directed toward a station where the single pouches are formed.

The forming station comprises a tubular element, placed at the outlet of the duct and functioning as a mandrel over which to fashion a tubular envelope of paper wrapping material.

The material in question consists in a continuous web decoiled from a roll and fed in a direction parallel to the axis of the tubular element, which is wrapped progressively around the element and sealed longitudinally.

Beyond the tubular element, the machine is equipped with transverse sealing means of which the operation is synchronized with the transfer of the tobacco portions, in such a way that each successive portion will be sealed in a relative segment of the continuous tubular envelope of wrapping material delimited by two successive transverse seals.

The successive tubular segments of wrapping material, formed as pouches containing respective portions of tobacco, are separated into discrete units through the action of cutting means positioned downstream of the transverse sealing means.

A conventional machine of the type outlined above, while dependable, is nonetheless limited in terms of operating speed and unable to match the tempo of other units, connected directly downstream, by which given numbers of the single pouches are assembled in packs for distribution.

Above certain operating speeds, in effect, and especially when handling tobacco with a high moisture content, there is no guarantee with machines of the type described above that the quantities of tobacco supplied to the form-fill-and-seal station will be portioned accurately and repeatably over time.

This is due to the fact that a correct transfer of the single portions of tobacco is conditional on each cavity remaining in the transfer station for a given minimum period of time, sufficient for the pneumatic means to remove the contents of the selfsame cavity completely.

The object of the present invention is to provide a machine for manufacturing single pouches of smokeless tobacco that will be unaffected by the drawbacks mentioned above in connection with machines of the prior art, and able to combine a high production tempo with an accurate and constantly repeatable transfer of tobacco portions into successive pouches.

DISCLOSURE OF THE INVENTION

The stated object is realized, according to the present invention, in a machine for manufacturing pouches of cohesionless material, as characterized in one or more of the claims appended.

SHORT DESCRIPTION OF THE DRAWINGS

The invention will now be described in detail, by way of example, with the aid of the accompanying drawings, in which.

Figure 1:
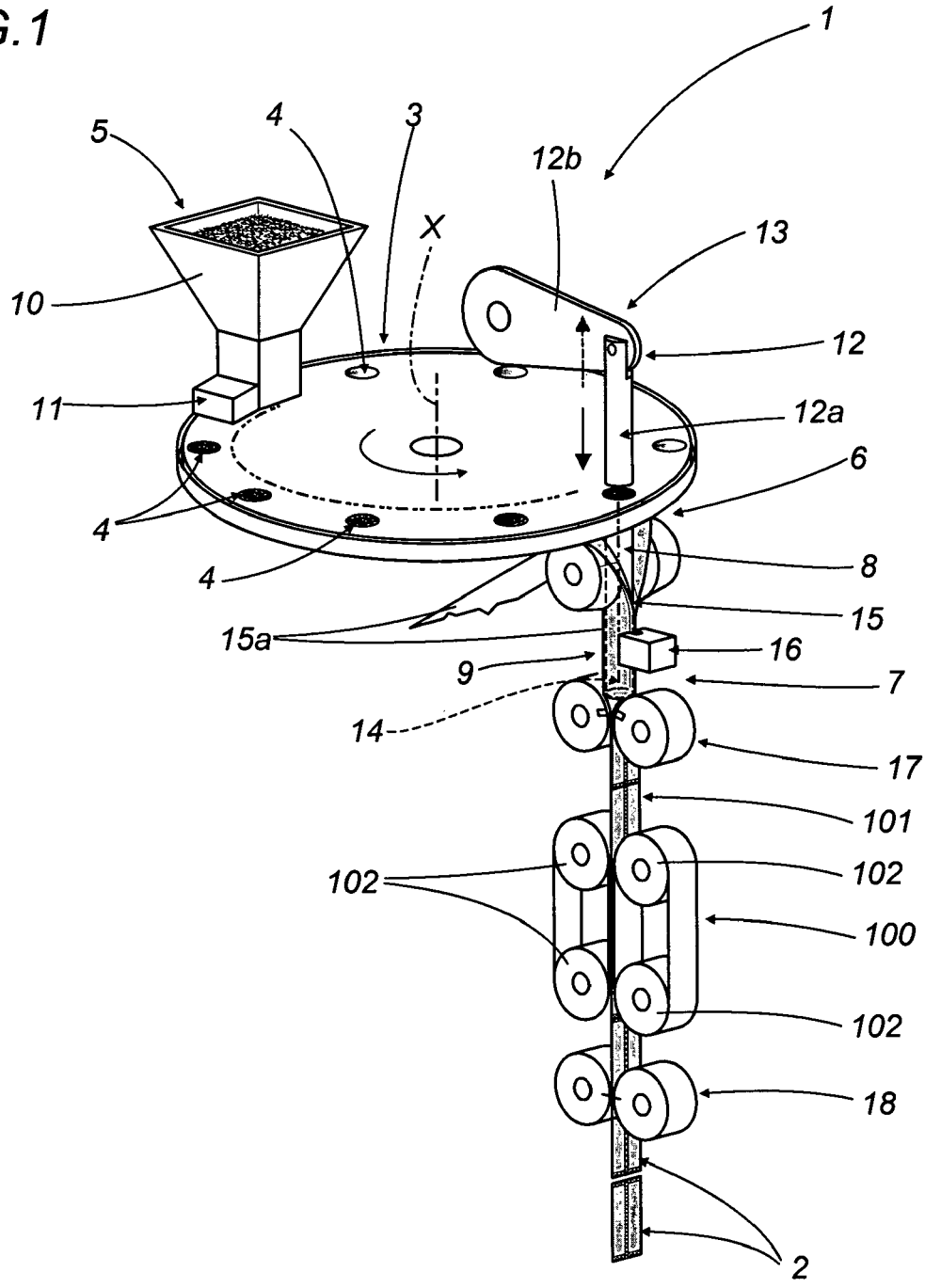
FIG. 1 shows a machine for manufacturing single pouches of a smokeless tobacco product according to the present invention, viewed schematically in perspective and illustrated in a first possible embodiment.
Figure 3A:
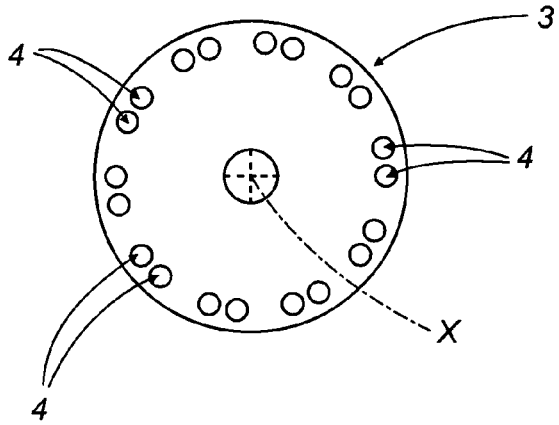
Figure 3B:
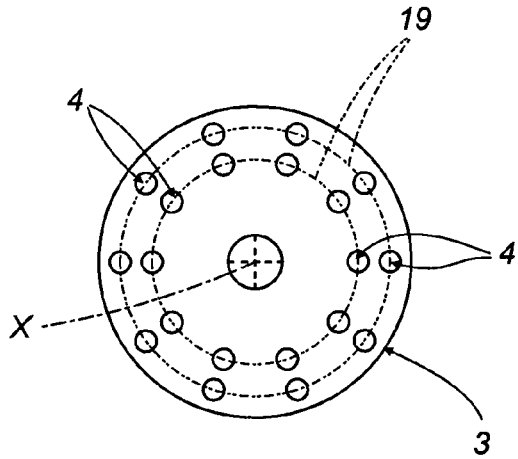
Figure 4:
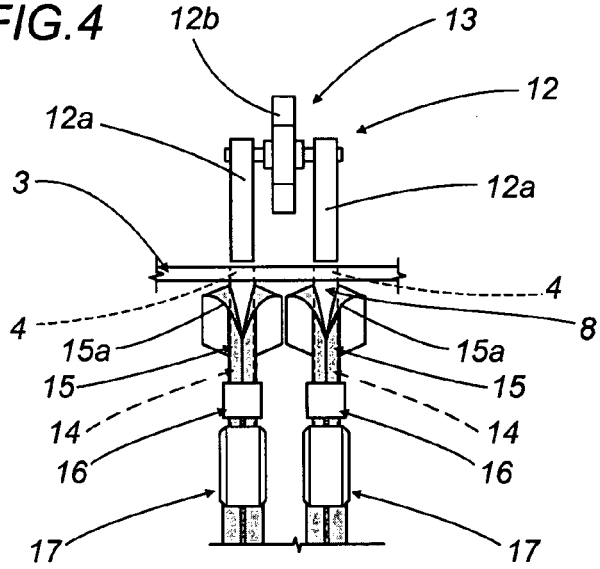

FIGS. 3*a* and 3*b* show a detail of the machine as in FIG. 1, viewed in plan from above and illustrated respectively in a second and a third embodiment;

FIG. 4 shows a detail of the machine as in the second or third embodiment of FIG. 3*a* or 3*b*, viewed from the front.

DETAILED DESCRIPTION OF THE PREFERRED EMBODIMENTS OF THE INVENTION

With reference to the accompanying drawings, numeral 1 denotes a machine for manufacturing pouches 2 of a smokeless tobacco product.

The machine 1 comprises a dispensing disc 3, furnished with a plurality of cavities 4 arranged around the periphery.

The disc 3 rotates intermittently about a relative axis X between a station 5 at which each of the single cavities 4 is filled with a predetermined quantity of tobacco, and a transfer station 6 at which the successive portions of tobacco are ejected from the relative cavities 4.

The machine 1 further comprises a wrapping station 7 at which the portions of tobacco removed from the transfer station 6 are taken up and enclosed in respective pouches 2, and a rectilinear duct 8 connecting the transfer station 6 with the wrapping station 7.

More exactly, the rectilinear duct 8 is interposed between the cavity 4 currently occupying the transfer station 6, and the wrapping station 7.

The duct 8 thus provides interconnecting means, denoted 9, by which the transfer station 6 is linked to the wrapping station 7.

The filling station 5 comprises a hopper 10 from which portions of tobacco are fed into the cavities 4 of the disc 3, and skimming means 11 located downstream of the hopper 10, relative to the direction of rotation of the disc, serving to remove any excess tobacco from the cavity 4.

Referring to FIG. 1, the transfer station 6 is equipped with a mechanical push rod 12 designed to engage the cavity 4 positioned in alignment with the selfsame push rod 12.

The push rod 12 provides the machine 1 with ejector means 13, and is composed of a plunger 12*a* reciprocated by a cam mechanism 12*b* in such a way as to slide back and forth through the cavity 4.

The wrapping station 7 comprises a tubular element 14 positioned at the outlet end of the rectilinear duct 8, around which a tubular envelope 15 of wrapping material 15*a* is formed.

The wrapping material 15*a* is decoiled from a roll (not illustrated) and wrapped by degrees around the tubular element 14 through the agency of suitable folding means.

The tubular envelope 15 is sealed longitudinally by ultrasonic welders 16 operating in close proximity to the tubular element 14. Such welders might be of the type disclosed and claimed in publication WO2005/113218A1, for example, which is incorporated here in its entirety by reference in the interests of providing a full description.

Figure 2:
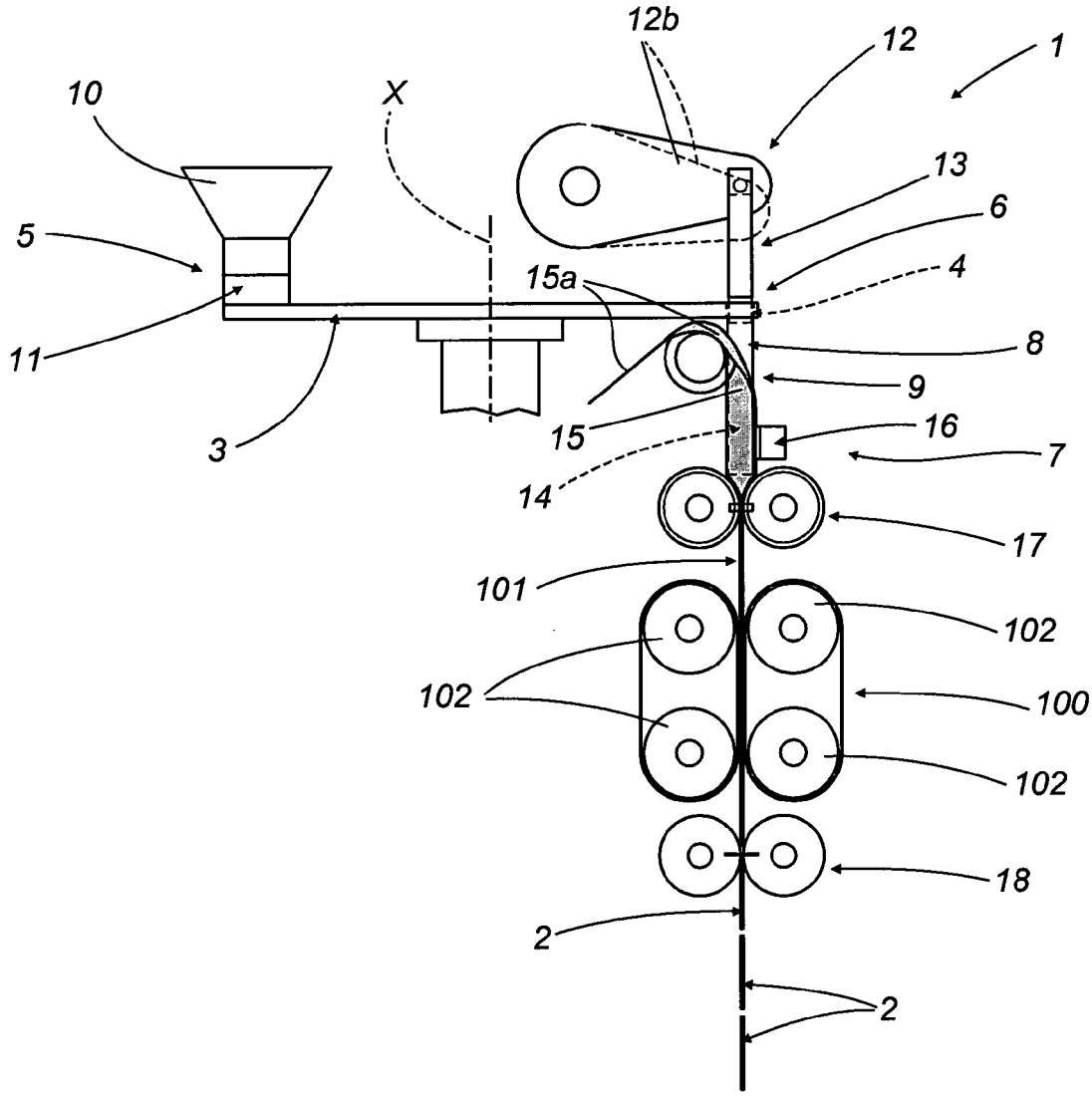
FIG. 2 shows the machine of FIG. 1, viewed schematically in a side elevation.

Referring to FIGS. 1 and 2, the machine 1 also comprises sealing means 17 located beneath the tubular element 14, of which the function is to bond the tubular envelope 15 transversely in such a manner as to form a continuous succession 101 of pouches 2, each containing a relative portion of tobacco.

The transverse sealing means 17 could likewise take the form of ultrasonic welders, in which case the above noted indications relative to the longitudinal welders 16 will apply in this instance also.

Downstream of the transverse sealing means 17, the machine 1 comprises a pair of transport belts 100 looped around respective pulleys 102, positioned to take up and direct the continuous succession 101 of pouches 2 toward cutting means 18 by which the selfsame succession 101 of pouches 2 is divided up into single units.

In operation, with the machine 1 set in motion, the disc 3 begins rotating and directs the single cavities 4 one by one under the hopper 10, from which each cavity 4 is filled with a given quantity of tobacco destined to provide the contents of one pouch 2.

As the disc 3 rotates, the cavity 4 passes under the skimming means 11, which will remove any excess tobacco released from the hopper 10.

Once the cavity 4 occupies the transfer station 6, the disc 3 pauses, thereby allowing the mechanical push rod 12 to engage the cavity 4 and eject the portion of tobacco contained therein.

The portion of tobacco is thus directed forcibly by the push rod 12 down through the rectilinear connecting duct 8 and into the tubular element 14, which is sheathed in the tubular envelope 15 of paper wrapping material 15*a*.

The envelope 15 of paper is sealed lengthwise by the ultrasonic welders 16, and crosswise, at the outlet end of the tubular element 14, by the transverse sealing means 17.

The operation of the transverse sealing means 17 is intermittent, and timed to match the frequency at which successive portions of tobacco are fed into the transfer station 6, in such a way that each portion of tobacco will be enclosed between two successive transverse seals.

As the welding or sealing operations proceed, a continuous succession 101 of tobacco-filled pouches 2 will emerge, connected one to the next by way of the transverse seals.

At a given point downstream of the transverse sealing means 17, the single pouches 2 of the continuous succession 101 are separated one from the next by the cutting means 18.

An alternative embodiment of the machine 1, illustrated in FIG. 3*b*, might be equipped with a disc 3 presenting two rings 19 of cavities aligned on two respective circumferences, disposed concentrically in relation to the axis X of the selfsame disc.

In this instance the mechanical push rod 12 will generate a dual action, or in practical terms, incorporate two plungers 12*a* deployed so that each engages a respective cavity 4, as illustrated in FIG. 4.

Alternatively, the machine could be equipped with two distinct mechanical push rods (not illustrated), one for each ring of cavities 4.

A further embodiment of the machine 1, illustrated in FIG. 3*a*, might be equipped with a disc presenting a single ring of cavities, arranged in pairs.

In either instance, a machine as illustrated in FIG. 3*a* or 3*b* will split below the disc into two distinct processing lines, as discernible in FIG. 4.

The machine disclosed affords key advantages.

Thanks to the adoption of a mechanical push rod, the machine is able to run at considerably high operating speeds.

More particularly, the force applied mechanically to the portion of tobacco is impulsive in nature, so that the time the plunger needs to dwell in the cavity beneath the push rod mechanism in order to transfer the tobacco correctly is briefer than in the case of a transfer effected utilizing pneumatic means.

Accordingly, the time the disc must remain stationary at the transfer station to ensure a clean ejection of the portion of tobacco is significantly reduced, and the production tempo of the machine can be correspondingly increased.

Furthermore, the use of ultrasonic welders is instrumental in allowing the adoption of a shorter rectilinear connecting duct, and consequently enabling the mechanical push rod to transfer the entire portion of tobacco correctly to the wrapping station.

The invention claimed is:

1. A machine for manufacturing pouches of at least one of a nasal snuff and a moist snuff for oral use, comprising:

a dispensing disc with cavities, rotatable about an axis, a filling station at which each cavity is filled with a predetermined portion of snuff, an ejection mechanism by which the portion of snuff is ejected from the dispensing disc at a transfer station, a wrapping station at which the portion of snuff is wrapped in a relative pouch, and an interconnecting mechanism interconnecting the transfer station and the wrapping station, wherein the filling station comprises:

a hopper from which portions of snuff are fed and dosed into each cavity of the dispensing disc, and a skimming mechanism located downstream of the hopper, relative to a direction of rotation of the disc, serving to remove any excess snuff from the cavity;

wherein the ejection mechanism comprises a mechanical pushing mechanism for engaging at least one of the cavities.

2. A machine as in claim 1, wherein the mechanical pushing mechanism reciprocates back and forth through the cavity.

3. A machine as in claim 2, wherein the interconnecting mechanism comprises a substantially rectilinear duct interposed between the cavity, when positioned at the transfer station, and the wrapping station.

4. A machine as in claim 3, wherein the wrapping station comprises a tubular element, at the outlet end of the duct, around which a tubular envelope of wrapping material is formed.

5. A machine as in claim 4, wherein the wrapping station comprises a longitudinal sealing mechanism for forming a longitudinal closure in the tubular envelope, and a transverse sealing mechanism for forming a transverse closure in the tubular envelope.

6. A machine as in claim 1, wherein the mechanical pushing mechanism engages a pair of cavities.

7. A machine as in claim 6, wherein the cavities of the pair are equidistant from the axis of rotation of the dispensing disc.

8. A machine as in claim 6, wherein the cavities of the pair are aligned on two rings coinciding with two respective circumferences centered on the axis of rotation of the dispensing disc.

9. A machine as in claim 5, wherein the longitudinal sealing mechanism includes an ultrasonic welder.

10. A machine as in claim 5, wherein the transverse sealing mechanism includes an ultrasonic welder.

* * * * *